US008136627B2

(12) United States Patent
Matsueda et al.

(10) Patent No.: US 8,136,627 B2
(45) Date of Patent: Mar. 20, 2012

(54) EXHAUST SILENCER DEVICE FOR INTERNAL COMBUSTION ENGINE

(75) Inventors: Koji Matsueda, Toyota (JP); Junichi Yamaguchi, Kasugai (JP)

(73) Assignee: Toyota Jidosha Kabushiki Kaisha, Aichi-Ken (JP)

( * ) Notice: Subject to any disclaimer, the term of this patent is extended or adjusted under 35 U.S.C. 154(b) by 0 days.

(21) Appl. No.: 12/676,769

(22) PCT Filed: Sep. 5, 2008

(86) PCT No.: PCT/IB2008/002306
§ 371 (c)(1),
(2), (4) Date: Mar. 5, 2010

(87) PCT Pub. No.: WO2009/031019
PCT Pub. Date: Mar. 12, 2009

(65) Prior Publication Data

US 2010/0300799 A1 Dec. 2, 2010

(30) Foreign Application Priority Data

Sep. 6, 2007 (JP) ..... 2007-231654

(51) Int. Cl.
*F01N 13/02* (2010.01)

(52) U.S. Cl. ..... 181/232

(58) Field of Classification Search ..... 181/232, 181/238, 239
See application file for complete search history.

(56) References Cited

U.S. PATENT DOCUMENTS

| | | | | | |
|---|---|---|---|---|---|
| 3,306,395 | A | * | 2/1967 | Jettinghoff | 181/227 |
| 3,317,001 | A | * | 5/1967 | Powers et al. | 181/232 |
| 3,348,629 | A | * | 10/1967 | Cassel | 181/232 |
| 3,396,812 | A | * | 8/1968 | Wilcox et al. | 181/250 |
| 3,589,469 | A | * | 6/1971 | Hasui et al. | 181/232 |
| 3,807,527 | A | * | 4/1974 | Bergson et al. | 181/232 |
| 3,853,200 | A | * | 12/1974 | Bergson et al. | 181/232 |
| 4,501,341 | A | * | 2/1985 | Jones | 181/250 |
| 4,513,841 | A | * | 4/1985 | Shimoji et al. | 181/252 |
| 4,596,306 | A | * | 6/1986 | Abe et al. | 181/228 |
| 4,779,703 | A | * | 10/1988 | Takiguchi et al. | 181/228 |
| 4,909,347 | A | * | 3/1990 | Wang | 181/272 |
| 5,245,140 | A | * | 9/1993 | Wu | 181/232 |

(Continued)

FOREIGN PATENT DOCUMENTS

JP 58-067916 A 4/1983

(Continued)

OTHER PUBLICATIONS

European Office Action for corresponding European Patent Application No. 08 806 999.2 issued on Nov. 4, 2010.

*Primary Examiner* — Jeremy Luks
(74) *Attorney, Agent, or Firm* — Sughrue Mion, PLLC

(57) ABSTRACT

An exhaust silencer device for an internal combustion engine which includes: an exhaust pipe (10) that forms an exhaust passage from an engine (1), and an exhaust opening; and a muffler (22) attached to the exhaust pipe (10) so as to silence exhaust sound from the engine (1). The piping lengths of the exhaust passages (L2, L3) on two sides of the muffler (22) are substantially equal. At least one of the two exhaust passages (L2, L3) equal in piping length has a hole (41) that makes the resonance frequencies of the two exhaust passages (L2, L3) different from each other.

12 Claims, 7 Drawing Sheets

U.S. PATENT DOCUMENTS

| | | | | | |
|---|---|---|---|---|---|
| 5,367,131 | A | * | 11/1994 | Bemel | 181/232 |
| 5,493,080 | A | | 2/1996 | Moss | |
| 5,519,994 | A | * | 5/1996 | Hill | 60/313 |
| 5,655,367 | A | * | 8/1997 | Peube et al. | 60/324 |
| 5,726,397 | A | | 3/1998 | Mukai et al. | |
| 6,938,729 | B2 | * | 9/2005 | Worner et al. | 181/254 |
| 2004/0261404 | A1 | * | 12/2004 | Vignassa et al. | 60/324 |

FOREIGN PATENT DOCUMENTS

| | | | | |
|---|---|---|---|---|
| JP | 59-194519 | U | | 12/1984 |
| JP | 59-226222 | A | | 12/1984 |
| JP | 61-190413 | U | | 11/1986 |
| JP | 63-61519 | U | | 4/1988 |
| JP | 63-110641 | U | | 7/1988 |
| JP | 01-022452 | B2 | | 4/1989 |
| JP | 04-262014 | A | | 9/1992 |
| JP | 05-44501 | Y2 | | 11/1993 |
| JP | 08-114117 | A | | 5/1996 |
| JP | 2001-098939 | A | | 4/2001 |
| JP | 2002-089228 | A | | 3/2002 |
| JP | 2004124912 | A | | 4/2004 |
| JP | 2004156535 | A | * | 6/2004 |
| JP | 2005023915 | A | * | 1/2005 |
| JP | 2005-105918 | A | | 4/2005 |
| JP | 2006-029224 | A | | 2/2006 |
| JP | 2006-057491 | A | | 3/2006 |

* cited by examiner

EXHAUST SILENCER DEVICE FOR INTERNAL COMBUSTION ENGINE

BACKGROUND OF THE INVENTION

1. Field of the Invention

The invention relates to an exhaust silencer device for an internal combustion engine. In particular, the invention relates to an exhaust silencer device for an internal combustion engine that is required of a silencing effect in a low rotation speed region of the engine.

2. Description of the Related Art

Lately, in a vehicle, such as a motor vehicle or the like, that is provided with an internal combustion engine, fine and delicate electronic control is performed in order to improve fuel economy, so that the vehicle travels with low throttle opening degree and low engine speed in an increased number of situations. Under such circumstances, in exhaust silencer devices for internal combustion engines, an arrangement is provided in order to meet a high requirement for the silencing performance against an unpleasant exhaust sound of a low frequency. That is, separately from a main muffler that silences exhaust sound from an internal combustion engine, a sub-muffler having a smaller muffler volume than the main muffler is provided so as to supplement the amount of silencing or improve the resonance characteristic of an exhaust path.

A known related-art exhaust silencer device of this kind for an internal combustion engine is, for example, an exhaust silencer device which has, in an exhaust path, a sub-muffler and a main muffler positioned downstream of the sub-muffler, and in which the main muffler has a multi-hole inner pipe that forms an exhaust passage and has many holes, an elongated casing that houses and surrounds the multi-hole inner pipe, and a sound absorbing material that is provided in a cylindrical space between the multi-hole inner pipe and the casing (see, e.g., Japanese Patent Application Publication No. 63-61519 (JP-A-63-61519), and Japanese Patent Application Publication No. 63-110641 (JP-A-63-110641)).

Besides, a device in which a main muffler is disposed in a front side and a rear muffler is provided in a rear end side of an exhaust pipe is also known (see, e.g., Japanese Patent Application Publication No. 2006-29224 (JP-A-2006-29224)).

Also known are a device that adopts as a sub-muffler a double resonance tube which has a resonance hole and a resonance chamber that communicates with the resonance hole (see, e.g., Japanese Utility Model Application Publication No. 61-190413 (JP-U-61-190413)), and a device in which an intermediate portion of the exhaust pipe has a double resonance tube structure so as to reduce the size of the main muffler (see, e.g., Japanese Patent Application Publication No. 2005-105918 (JP-A-2005-105918)).

In the foregoing related-art exhaust silencer devices for internal combustion engines, however, when the position of the downstream-side muffler is near an outlet of the exhaust pipe (exhaust opening) as shown in FIG. 8A, a sufficient silencing performance against the exhaust sound of a low frequency range near the idling vibration range cannot be achieved. Specifically, the exhaust passage length between the main muffler and the sub-muffler is long, and therefore, the air column resonance that occurs in that interval is of a very low frequency (e.g., in the vicinity of 30 Hz to 50 Hz), so that the exhaust sound deteriorates. Despite this, the muffler is disposed at a position of low sound pressure and low particle velocity that is near a node of the resonance mode as shown in FIG. 8B. Therefore, the silencing efficiency is low. Therefore, the muffler volume cannot be restrained, so that it is difficult to make the device compact or reduce the costs.

On the other hand, in the case where the downstream-side muffler is apart from the outlet (exhaust opening) of the exhaust pipe, and exhaust pipes having substantially equal piping lengths are present on two sides of the downstream-side muffler, there occurs coincidence between resonance frequencies of the exhaust pipes on the two sides, giving rise to a problem of exciting an exhaust sound of a relatively high frequency (e.g., in the vicinity of 150 Hz to 180 Hz).

Besides, due to the understanding that the muffler with a sound absorbing material is suitable for the silencing of relatively high-frequency sound and that the larger the muffler volume, the higher the silencing effect, a muffler with a sound absorbing material has not been effectively utilized to silence the aforementioned low-frequency exhaust sound. In this respect, too, the muffler volume cannot be restrained, so that it is difficult to make the device compact or reduce the costs.

SUMMARY OF THE INVENTION

The invention provides a compact and low-cost exhaust silencer device that is excellent in both the silencing performance against low-frequency exhaust sound and the silencing performance against high-frequency exhaust sound while the muffler capacity is restrained.

An exhaust silencer device for an internal combustion engine in accordance with a first aspect of the invention includes: an exhaust pipe that forms an exhaust passage extending from the internal combustion engine; and an exhaust opening, and a muffler attached to the exhaust pipe so as to silence exhaust sound from the internal combustion engine. In the exhaust silencer device, exhaust passages on two sides of the muffler are substantially equal in piping length, and one of the exhaust passages has a hole that makes resonance frequencies of the exhaust passages on the two sides different from each other.

Due to this construction, even if the air column resonance that occurs in an elongated exhaust passage is of a very low frequency, a good silencing efficiency can be secured since the muffler is disposed at a position of high sound pressure that is near a loop of the low-frequency resonance mode. Besides, although the piping lengths of the exhaust passage on the two sides of the muffler are substantially equal, the hole formed on at least one of the two exhaust passages makes the resonance modes of these exhaust passages different from each other. This restrains the occurrence of a problem of the coincidence between the resonance frequencies exciting the exhaust sound of a relatively high frequency. Therefore, the first aspect of the invention provides a compact and low-cost exhaust silencer device that is excellent in both the silencing performance against the exhaust sound of a low frequency and the silencing performance against the exhaust sound of a relatively high frequency while the muffler volume is restrained.

In the first aspect, the muffler may include a multi-hole inner pipe that forms a portion of the exhaust passage and that has a plurality of holes, a casing that houses and surrounds the multi-hole inner pipe, and a sound absorbing material provided in a space between the multi-hole inner pipe and the casing.

Due to this construction, at a position near a loop of the resonance mode of a low frequency of the long exhaust passage length that includes the exhaust passages on both sides of the muffler, the resonance sound produced by high-sound pressure and high-particle velocity exhaust gas passing through the multi-hole inner pipe of the muffler is absorbed by the sound absorbing material. Thus, the exhaust sound is reduced. Besides, the pressure resistance of the muffler that has the multi-hole inner pipe, in comparison with that of an expanded type silencing structure, is practically as small as that of an ordinary exhaust pipe. Therefore, the exhaust resistance can also be restrained.

An exhaust silencer device for an internal combustion engine in accordance with a second aspect of the invention includes: an exhaust pipe that forms an exhaust passage extending from the internal combustion engine, and an exhaust opening; a main muffler attached to the exhaust pipe so as to silence exhaust sound from the internal combustion engine; and a sub-muffler that is attached to the exhaust pipe and that is smaller in muffler volume than the main muffler. The sub-muffler is disposed on a middle portion of a length of a first exhaust passage extending from an outlet of the main muffler to the exhaust opening of the exhaust pipe, and in the first exhaust passage, at least one of a second exhaust passage extending from the outlet of the main muffler to an inlet of the sub-muffler and a third exhaust passage extending from an outlet of the sub-muffler to the exhaust opening of the exhaust pipe has a hole that makes resonance frequencies of the second exhaust passage and of the third exhaust passage different from each other.

In the second aspect, the sub-muffler may have a multi-hole inner pipe that forms the exhaust passage and that has a plurality of holes, a casing that houses and surrounds the multi-hole inner pipe, and a sound absorbing material provided in a space between the multi-hole inner pipe and the casing. The casing may form, around the multi-hole inner pipe, a sound absorbing material-housing space having a large sectional area that is suitable to reduce a low-frequency exhaust sound that occurs corresponding to the length of the first exhaust passage.

Due to this construction, even if the air column resonance that occurs in an elongated first exhaust passage with the sub-muffler disposed on a middle portion thereof is of a very low frequency, the column resonance sound of the very low frequency can be efficiently silenced since a large cross-section sub-muffler that has the multi-hole inner pipe and the sound-absorbing material around the multi-hole inner pipe is disposed on the middle portion of the first exhaust passage which is near a loop of the resonance mode of the low frequency and which experiences the heightening of both the sound pressure and the particle velocity. Besides, although the piping lengths of the second exhaust passage and the third exhaust passage on the two sides of the sub-muffler are substantially equal, the hole formed on the second exhaust passage or the third exhaust passage makes the resonance modes of these exhaust passages different from each other. This restrains the coincidence between resonance frequencies exciting the exhaust sound of a relatively high frequency. Therefore, the invention provides a compact and low-cost exhaust silencer device that is excellent in both the silencing performance against the exhaust sound of a low frequency and the silencing performance against the exhaust sound of a relatively high frequency while the muffler volume is restrained. Incidentally, the section or cross-section of the sub-muffler herein is a transverse section perpendicular to the exhaust passage.

In the second aspect, a resonance tube may be attached to a portion of the exhaust pipe so as to form a resonance chamber that communicates with the hole.

In this case, besides the hole making the resonance frequencies of the second exhaust passage and the third exhaust passage different from each other, a silencing effect by the resonance tube can be expected.

The resonance tube may surround a portion of the exhaust pipe so that a double resonance tube is formed.

This construction can restrain the installation space of the resonance tube while securing the silencing effect of the resonance tube.

The resonance tube may be a one-end-closed type resonance tube that surrounds the hole and that branches from the exhaust pipe.

This construction allows the resonance tube to be attached by substantially the same method as used for the exhaust pipe, and thus facilitates the manufacture thereof.

The resonance tube may be attached to a portion of the exhaust pipe that forms the third exhaust passage.

In this case, the resonance tube can easily be installed, and a more reliable silencing effect near the exhaust opening can be expected.

The large sectional area may be 20 times to 25 times as large as a passage sectional area of the multi-hole inner pipe.

Due to this construction, the sound absorbing material-housing space formed behind the multi-hole inner pipe by the casing has a size that is effective in the silencing achieved by the cooperation with the sound absorption of the sound absorbing material provided inside the sound absorbing material-housing space. Thus, a sufficient silencing effect can be expected.

The sub-muffler may be shorter in total length in a passage direction of the first exhaust passage than the main muffler.

In this case, it does not happen that a wastefully large amount of the sound absorbing material is contained. Thus, the production cost and the installation space for the sub-muffler can be restrained. Besides, the sub-muffler can easily be disposed on a lower surface side of the vehicle body in which space is limited.

According to the foregoing aspects of the invention, the muffler is disposed at a position near the loop of the resonance mode of the elongated exhaust passage, and at least one of the exhaust passages on both sides of the muffler that have substantially equal piping lengths has the hole, which makes the resonance frequencies of the two exhaust passages different from each other. Therefore, it is possible to provide a compact and low-cost exhaust silencer device that is excellent in both the silencing performance against low-frequency exhaust sound and the silencing performance against relatively high-frequency exhaust sound.

In the case where the main muffler and the sub-muffler are provided, the sub-muffler having a large sectional area that has the multi-hole inner pipe and the sound absorbing material around the multi-hole inner pipe is disposed on a middle portion of the first exhaust passage that is near the loop of a low-frequency resonance mode of the elongated first exhaust passage and that experiences the heightening of both the sound pressure and the particle velocity. Therefore, the air column resonance sound of the low frequency can be efficiently silenced. Besides, although the piping lengths of the second exhaust passage and the third exhaust passage on the two sides of the sub-muffler are substantially equal, the hole formed on the second exhaust passage or the third exhaust passage makes the resonance modes of these exhaust passages different from each other. This construction restrains the coincidence of resonance frequencies exciting the exhaust sound of relatively high frequencies. In consequence, it is possible to provide a compact and low-cost exhaust silencer device that is excellent in both the silencing performance against low-frequency exhaust sound and the silencing performance against relatively high-frequency exhaust sound while the muffler volume is restrained.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein:

FIG. 3A is a transverse sectional view of the sub-muffler, and FIG. 3B is a longitudinal sectional view of the sub-muffler;

FIG. 4A shows a resonance mode that is dominant in a first exhaust passage and produces an unpleasant low-frequency exhaust sound, and FIG. 4B shows a resonance mode of a relatively high frequency that occurs upstream and downstream of a sub-muffler with a sound absorbing material when such a sub-muffler is disposed on a middle portion of the first exhaust passage;

DETAILED DESCRIPTION OF EMBODIMENTS

Embodiments of the invention will be described hereinafter with reference to the drawings.

First Embodiment

Figure 1:
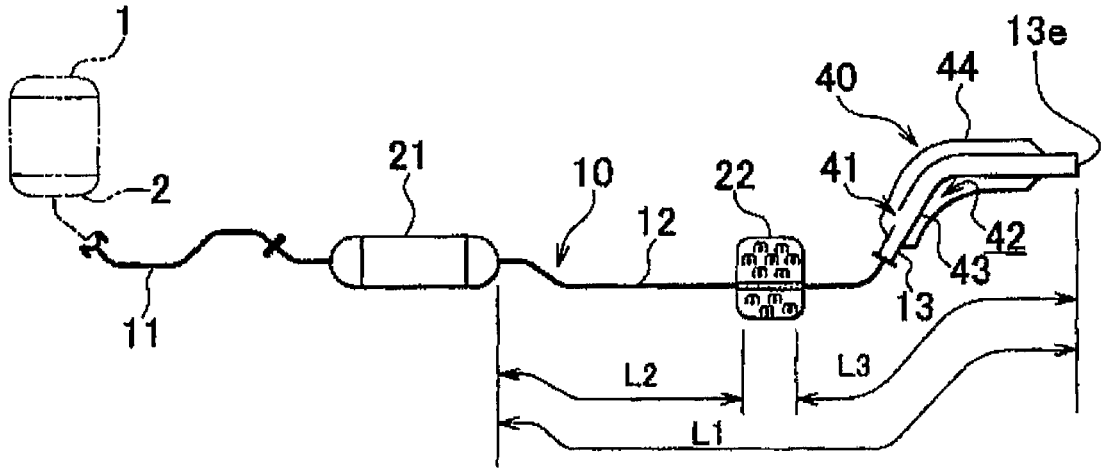
FIG. 1 is a schematic diagram showing a general construction of an exhaust silencer device for an internal combustion engine in accordance with a first embodiment of the invention.
Figure 2:
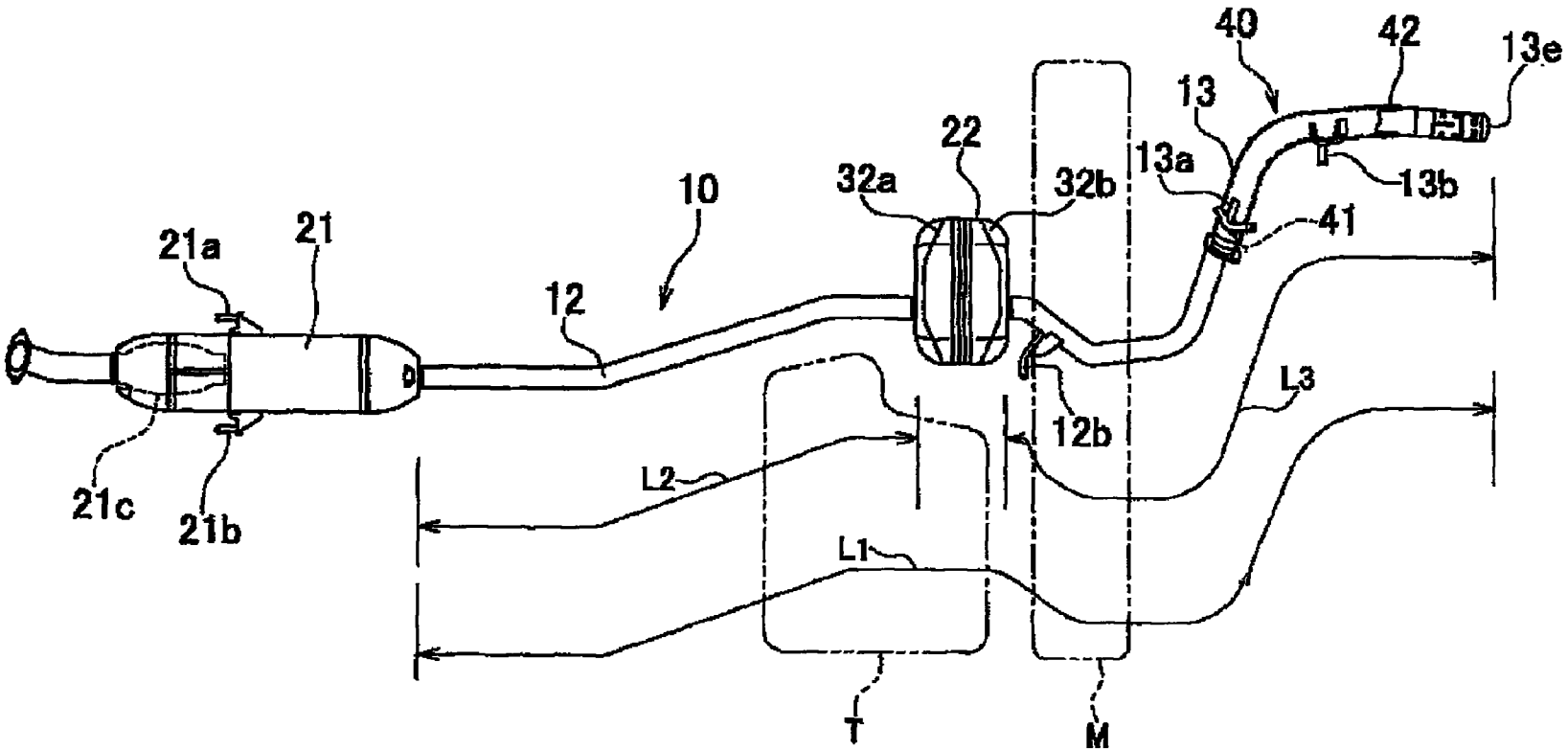
FIG. 2 is a plan view showing a layout of an exhaust pipe of the exhaust silencer device for an internal combustion engine in accordance with the first embodiment.
Figure 3A:
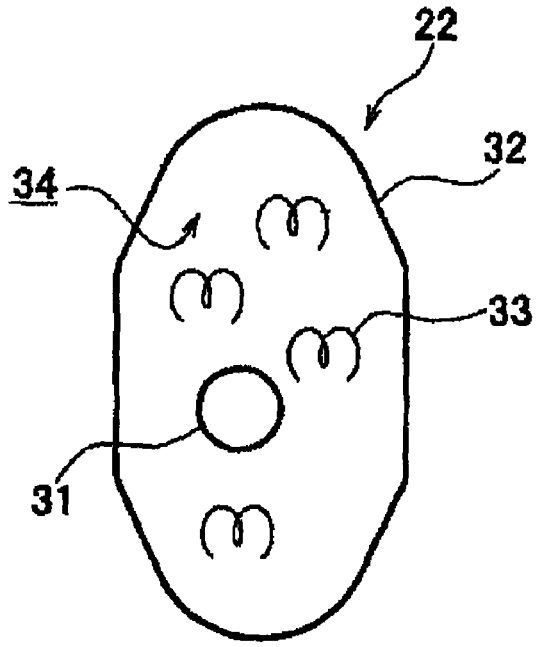
FIGS. 3A and 3B show sections of a sub-muffler of the exhaust silencer device for an internal combustion engine in accordance with the first embodiment.
Figure 3B:
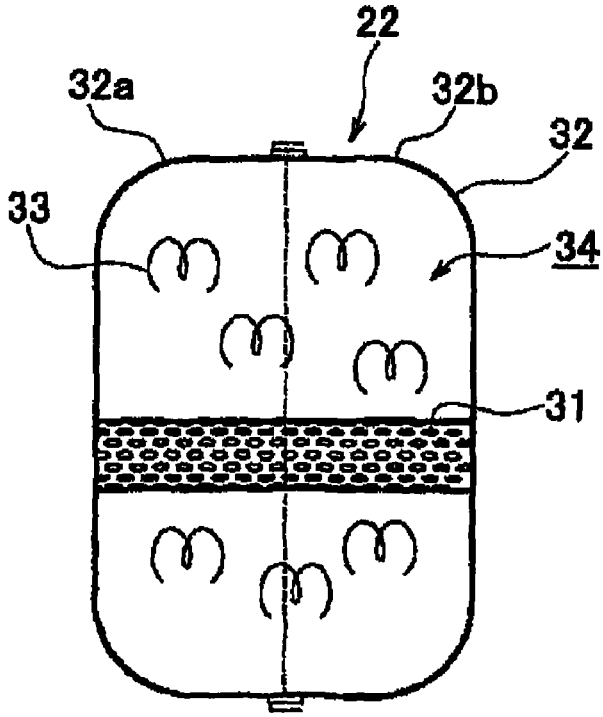

FIG. 1 is a schematic diagram showing a general construction of an exhaust silencer device for an internal combustion engine in accordance with a first embodiment of the invention. FIG. 2 is a plan view showing a layout of an exhaust pipe of the exhaust silencer device for an internal combustion engine in accordance with the first embodiment. FIG. 3A is a transverse sectional view of the sub-muffler, and FIG. 3B is a longitudinal sectional view of the sub-muffler.

As shown in FIGS. 1 and 2, in the first embodiment, an exhaust pipe 10 is connected to an engine 1 that is an internal combustion engine for a vehicle. The engine 1 is constructed as a multi-cylinder internal combustion engine, for example, an in-line four-cylinder four-stroke engine, and is supported by an engine mount on a vehicle body side. Besides, an exhaust manifold 2 is fastened to the engine 1. A junction pipe portion (not shown in detail) of the exhaust manifold 2 is connected to the exhaust pipe 10.

The exhaust pipe 10 is constructed of a front pipe 11 that forms an upstream end side portion of the exhaust pipe 10, a center pipe 12 having an end portion that is coupled by flange or coupled by spherical pipe joint to the front pipe 11, and a rear pipe 13 that is flange-coupled to the other end portion of the center pipe 12. The exhaust pipe 10 extends in the longitudinal direction of the vehicle.

Besides, a main muffler 21 is attached to an upstream end-side portion of the center pipe 12. A sub-muffler 22 having a smaller muffler volume than the main muffler 21 is attached to an intermediate portion of the center pipe 12 so as to be positioned substantially at the midpoint of a first exhaust passage L1 that extend from the outlet of the main muffler 21 to an exhaust opening 13*e* at a downstream end of the exhaust pipe 10.

As shown in FIG. 2, the exhaust pipe 10 is supported on the vehicle body side by left and right-side mount brackets 21*a*, 21*b* attached to the main muffler 21, a mount bracket 12*b* attached to the center pipe 12 in the vicinity of the sub-muffler 22, and mount brackets 13*a*, 13*b* attached to the rear pipe 13.

The main muffler 21 can be constructed of a known silencer that reduces the exhaust sound from the engine 1 in the exhaust pipe 10. Although not shown in detail, the main muffler 21 in the first embodiment contains a catalyst unit 21*c* for exhaust purification at its inlet side, and has an expansion-type or resonance-type silencing chamber around and downstream of the catalyst unit 21*c* so as to achieve a silencing effect, and an exhaust cooling effect due to adiabatic expansion.

The sub-muffler 22, as shown in FIG. 3, has a multi-hole inner pipe 31 that is circular in section and has many holes and that is disposed in an intermediate portion of the exhaust pipe 10 and forms a portion of the exhaust passage, a casing 32 that houses and surrounds the multi-hole inner pipe 31, and a fiber-type sound absorbing material 33 that is provided between the multi-hole inner pipe 31 and the easing 32 and that is made of, for example, glass wool.

It is to be noted herein that the casing 32 is formed by joining a pair of recessed case members 32*a*, 32*b* face to face so as to secure and retain the multi-hole inner pipe 31 and form, around the multi-hole inner pipe 31, a sound absorbing material-housing space 34 for housing the sound absorbing material 33. In the sub-muffler 22, since the casing 32 forms a cavity around the multi-hole inner pipe 31 (behind the holes thereof), a resonance-type silencing effect is delivered, and since the sound absorbing material 33 is housed in the cavity, the effect of silencing by the sound absorbing material 33 (converting the sound pressure vibration into thermal energy) is delivered.

Besides, the casing 32, as shown in FIG. 2, is fixed to the exhaust pipe 10 at its middle portion in the direction of length of the first exhaust passage L1 extending from the outlet of the main muffler 21 to the exhaust opening 13*e* of the exhaust pipe 10, and defines therein a sound absorbing material-housing space 34 which has a large sectional area suitable to dampen the exhaust sound of a low frequency (e.g., 30 Hz to 50 Hz) that occurs corresponding to the length of the first exhaust passage L1 in a low rotation speed region of the engine 1 and which is shorter than the length that is ordinarily set for that large sectional area. The large sectional area herein is a sectional area that is, for example, 20 to 25 times as large as the passage sectional area of the multi-hole inner pipe 31. It is preferable that the large sectional area be at least greater than 15 times the passage sectional area of the multi-hole inner pipe 31 although it varies depending on the amount of the sound absorbing material 33 provided, the property thereof, etc. The holes of the multi-hole inner pipe 31 are formed around the entire circumference at equal pitches, and the diameter of the holes is normally 4 mm (diameter), which is suited for the hole blanking processing of a metallic multi-hole pipe.

As for the sub-muffler 22 constructed as described above, the total length thereof in the passage direction of the first exhaust passage L1 is shorter than that of the main muffler 21. The sub-muffler 22 is disposed between a fuel tank T and a rear suspension member M of a vehicle in which the engine 1 is mounted.

In the first exhaust passage L1 of the exhaust pipe 10, a third exhaust passage L3 extending from the outlet of the sub-muffler 22 to the exhaust opening 13*e* of the exhaust pipe 10 has in an intermediate portion thereof a resonance hole 41 (see FIGS. 1 and 2) that is a hole for making the resonance frequencies of a second exhaust passage L2 and of the third exhaust passage L3 different from each other. The resonance hole 41 is formed on at least one of the second exhaust passage L2 and the third exhaust passage L3; for example, it is formed in the vicinity of an upstream end of a rear pipe 13 that forms a portion of the third exhaust passage L3 of the exhaust pipe 10. The resonance hole 41 has a hole diameter that causes the third exhaust passage L3 to be a passage that has an open end at the position at which the resonance hole 41 is formed. Incidentally, the holes for making the resonance frequencies of the two exhaust passage pipes different from each other may also be formed on the second exhaust passage L2 and the third exhaust passage L3, for example, in such a manner that the distances of the resonance holes to the sub-muffler 22 are different from each other.

Concretely, the sub-muffler 22 is positioned substantially in the middle of the first exhaust passage L1, which extends from the downstream side of the main muffler 21. Therefore, in the first exhaust passage L1, the two exhaust passages L2, L3 on both sides of the sub-muffler 22 have substantially equal piping lengths. Since the resonance hole 41 is formed, for example, on the exhaust passage L3, the resonance mode of the exhaust passage L3 on the downstream side of the sub-muffler 22 has a node at the position of the resonance hole 41, and is different from the resonance mode of the exhaust passage L2 on the upstream side of the sub-muffler 22. Besides, due to the presence of the resonance hole 41, the air column resonance frequencies of the exhaust passages L2, L3 on both sides of the sub-muffler 22 are different from each other.

The rear pipe 13 is provided with a double resonance tube 40 that forms a resonance chamber 42 that communicates with the resonance hole 41.

The double resonance tube 40 has an inner pipe 43 that surrounds a portion of the exhaust passage of the exhaust pipe 10, and an outer pipe 44 provided so that the tubular resonance chamber 42 is defined between the outer pipe 44 and the inner pipe 43. The resonance hole 41 is positioned in an upstream end-side portion of the inner pipe 43. The double resonance tube 40 has a so-called resonance type silencer structure that is formed by the resonance hole 41 and the resonance chamber 42 provided behind the resonance hole 41. Such a resonance type silencer structure is generally effective for silencing a specific frequency. In the double resonance tube 40 in the first embodiment, however, an intermediate portion of the exhaust passage L3 on the downstream side of the sub-muffler 22 is caused to have an open end (i.e., have a node of the resonance mode) by the provision of the resonance hole 41, so that the exhaust passages L2, L3 on both sides of the sub-muffler 22 are made different from each other in the air column resonance frequency or the resonance mode. Therefore, the double resonance tube 40 plays a role as a resonance mode controller, and does not need to meet such severe requirements in volume or other conditions as it does as a silencer. Therefore, the volume of the resonance chamber 42 may be, for example, less than 1 L (liter), for example, about 0.5 L to 0.9 L.

Next, operation of the foregoing construction will be described.

During the operation of the engine 1, as high-temperature and high-pressure exhaust is discharged from the engine 1 into the exhaust pipe 10 sequentially in accordance with the predetermined explosion sequence of the engine 1, the exhaust pressure in the exhaust pipe 10 fluctuates according to the rotation of the engine 1, producing exhaust sound. The exhaust sound is silenced (dampened) by the main muffler 21 in the center pipe 12, and is then silenced also by the sub-muffler 22, and in addition is slightly silenced in the double resonance tube 40 as well. Besides, the exhaust gas in the exhaust pipe 10 is cooled due to the adiabatic expansion in the main muffler 21 or heat dissipation from the exhaust path.

Let it assumed herein that the engine 1 is being operated in a low rotation speed region, for example, with a small degree of throttle opening of about 15%. In that case, air column resonance occurs in the elongated first exhaust passage L, so that the exhaust sound, which is generally of a very low frequency according to the resonance mode thereof, for example, about 40 Hz to 50 Hz, increases, producing an unpleasant exhaust sound. However, in the first embodiment, the air column resonance sound of such a low frequency can be efficiently silenced. Particularly in the first embodiment, since the aforementioned large sectional area of the sub-muffler 22 is 20 times to 25 times the passage sectional area of the multi-hole inner pipe 31, the sound absorbing material-housing space 34 formed behind the multi-hole inner pipe 31 by the casing 32 has a size that is effective for the silencing achieved by the cooperation with the sound absorption of the sound absorbing material 33 provided within the sound absorbing material-housing space 34, so that a sufficient silencing effect can be expected.

Figure 4A:
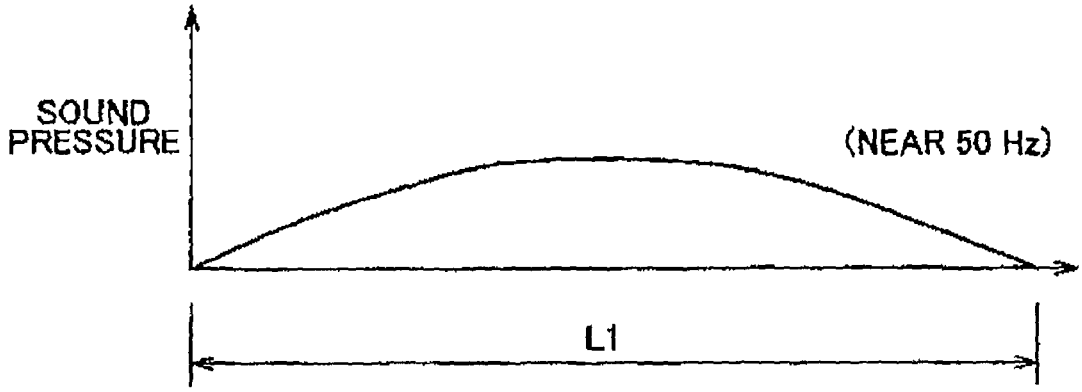
FIGS. 4A and 4B are illustrative diagrams for resonance modes in an exhaust passage that produce exhaust sound that is to be silenced by the exhaust silencer device for an internal combustion engine in accordance with the first embodiment.

That is, since as shown in FIG. 4A the large-section sub-muffler 22 having the multi-hole inner pipe 31 and the sound absorbing material 33 around the multi-hole inner pipe 31 is disposed near the loop of the resonance mode of a low frequency that is dominant in the first exhaust passage L1, that is, substantially in the middle of the first exhaust passage L1 where both the sound pressure and the particle velocity are high, a considerable silencing effect in the low engine speed region can be expected.

Figure 4B:
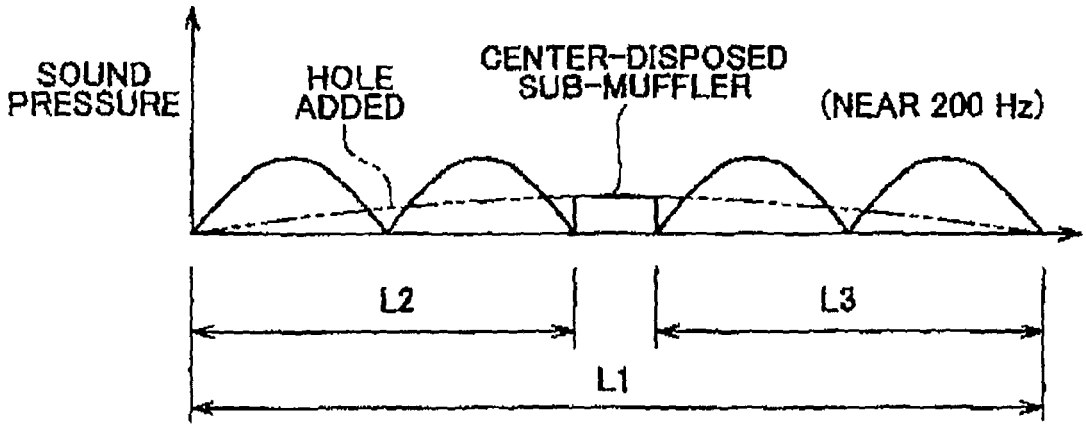

However, merely disposing the sub-muffler 22 substantially in the middle of the first exhaust passage L1 results in the coincidence between the resonance frequencies of the second exhaust passage L2 and the third exhaust passage L3, so that a resonance mode as shown in FIG. 4B occurs in the vicinity of 200 Hz. Thus, the silencing performance against the exhaust sound at a relatively high frequency declines. In the first embodiment, however, although the piping lengths of the second exhaust passage L2 and the third exhaust passage L3 on both sides of the sub-muffler 22 are substantially the same, the resonance hole 41 formed on the third exhaust passage L3 causes the third exhaust passage L3 to have an open end in an intermediate portion thereof, and thus makes the air column resonance frequencies of the exhaust passages L2, L3 different from each other. Thus, the first embodiment mitigates the problem of the silencing performance against the exhaust sound of a relatively high frequency declining due to the coincidence between the resonance frequencies of the second exhaust passage L2 and the third exhaust passage L3.

Therefore, the first embodiment provides a compact and low-cost exhaust silencer device that is excellent in the silencing performance against low-frequency exhaust sound and the silencing performance against relatively high-frequency exhaust sound while the volumes of the main muffler 21 and the sub-muffler 22 are restrained.

Figure 5A:
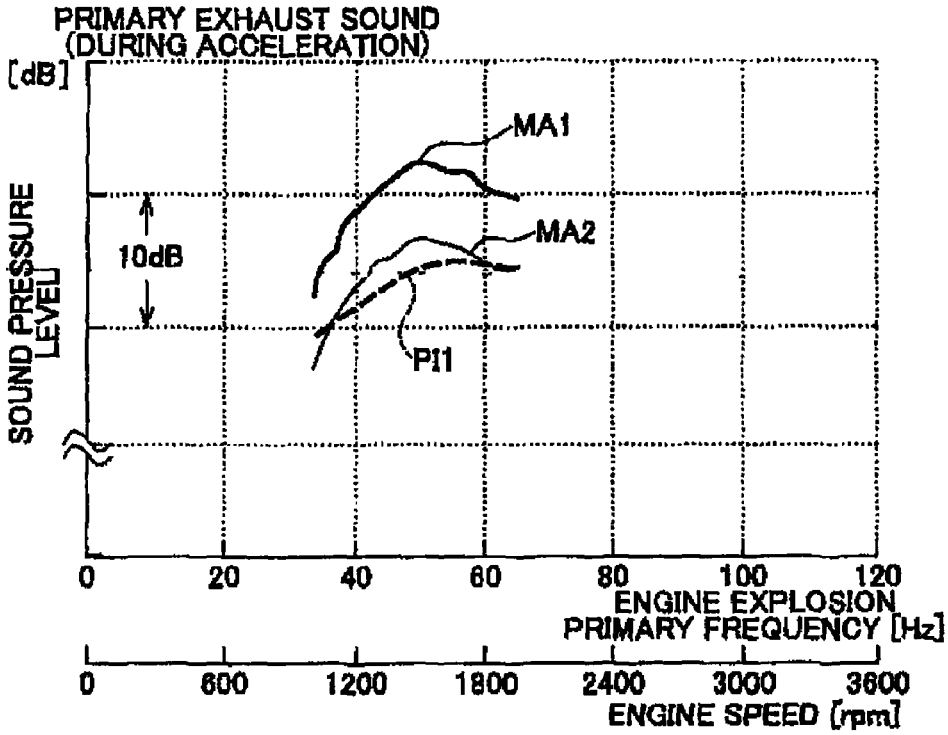
FIGS. 5A and 5B are silencing characteristic diagrams showing the silencing effect of the exhaust silencer device for an internal combustion engine in accordance with the first embodiment in comparison with a plurality of comparative examples whose device constructions partially vary, in each of which the vertical axis represents the sound pressure level of a primary exhaust sound during acceleration, and the horizontal axis represents the engine explosion primary frequency and the engine rotation speed.
Figure 5B:
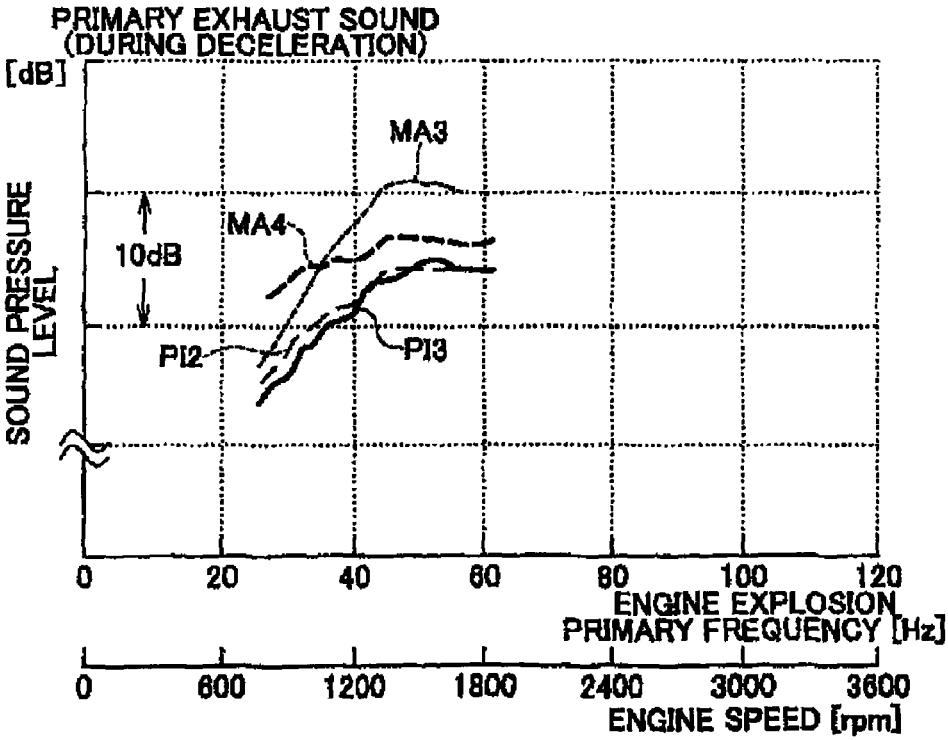

FIGS. 5A and 5B are silencing characteristic diagrams showing the silencing effect of the exhaust silencer device of the first embodiment in comparison with a plurality of comparative examples whose device constructions partially vary. In the diagrams, the vertical axis represents the sound pressure level of a primary exhaust sound during acceleration, and the horizontal axis represents the engine explosion primary frequency and the engine rotation speed.

In FIG. 5A, Comparative Example 1 shown by a solid line MA1 is a related-art system in which the main muffler and the sub-muffler are apart from each other, and the sub-muffler is disposed in the vicinity of the exhaust opening. Comparative Example 2 shown by a solid line MA2 is a related-art system in which the main muffler and the sub-muffler are apart from each other, and the sub-muffler is disposed in the vicinity of the exhaust opening, and in which the volume of the sub-muffler is increased to twice the volume the sub-muffler of Comparative Example 1. Example 1 shown by a broken line PI1 is a system that has the construction of the first embodiment but has substantially the same muffler volume as in Comparative Example 1.

From FIG. 5A, it can be understood that in Example 1 shown by the broken line PI1, since the sub-muffler 22 is disposed on a substantially middle portion of the first exhaust passage L1, the sound pressure level of exhaust sound of a low frequency in the vicinity of 40 Hz to 50 Hz can be effectively reduced in comparison with the Comparative Example 1, and greater contribution to the silencing effect can be achieved than in Comparative Example 2, while the volume of the sub-muffler 22 is not so much increased as in Comparative Example 2.

In FIG. 5B, Comparative Example 3 shown by a dotted line MA3 is a system in which the sectional area of the sub-muffler 22 is 6.4 times the channel cross-section of the multi-hole inner pipe 31, and Comparative Example 4 shown by a dotted line MA4 is a system in which the sub-muffler has a large sectional area without the sound absorbing material 33. Besides, Example 2 shown by a broken line PI2 is a system in which the sectional area of the sub-muffler 22 is 20.2 times the channel cross-section of the multi-hole inner pipe 31, and Example 3 shown by a solid line PI3 is a system in which the sectional area of the sub-muffler 22 is 25.3 times the channel cross-section of the multi-hole inner pipe 31.

From FIG. 5B, it can be understood that if the sectional area of the sub-muffler 22 is about 20 times to 25 times the channel cross-section of the multi-hole inner pipe 31 as in Examples 2 and 3, a considerable silencing effect against the unpleasant exhaust sound of a low frequency can be expected.

Figure 6A:
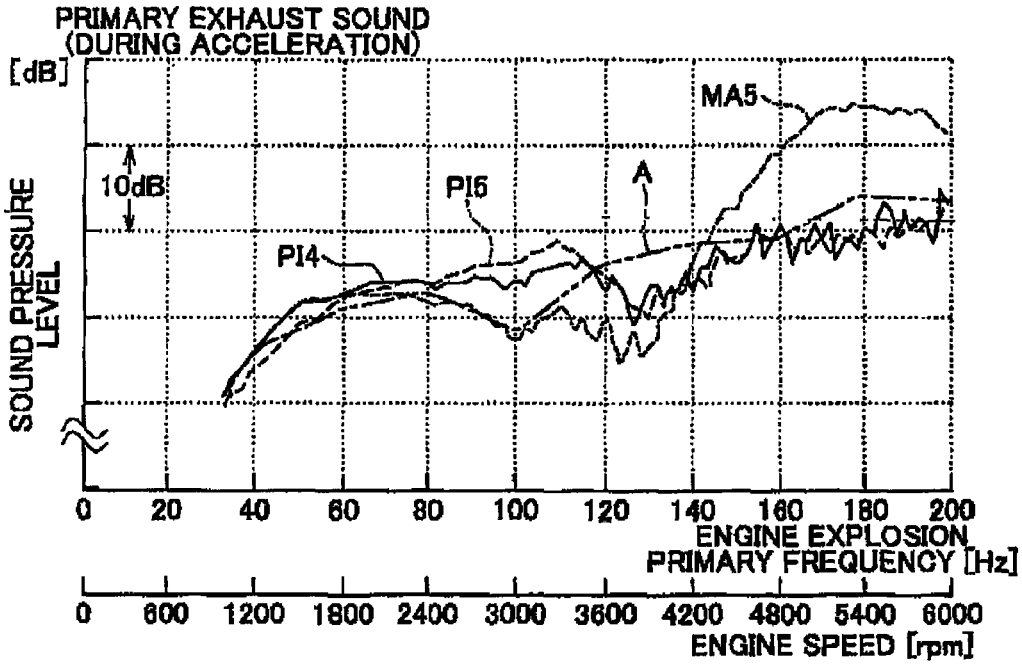
FIGS. 6A and 6B show results of experiments showing the silencing effect achieved by a resonance tube that has a resonance hole in the exhaust silencer device for an internal combustion engine in accordance with the first embodiment, in each of which the vertical axis represents the sound pressure level of a primary exhaust sound, and the horizontal axis represents the engine explosion primary frequency and the engine rotation speed.
Figure 6B:
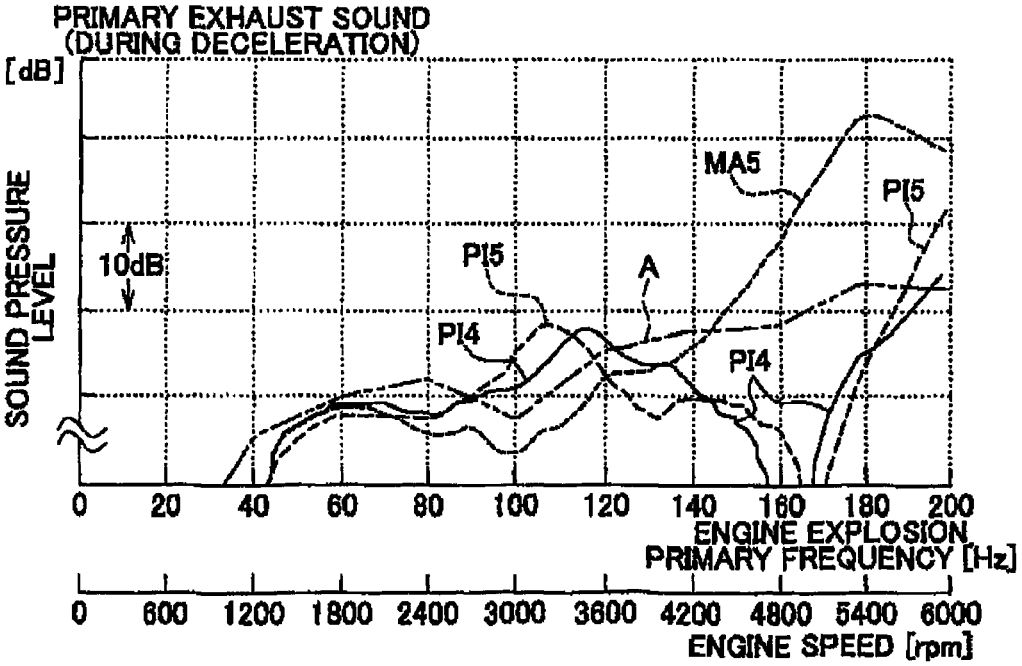

FIGS. 6A and 6B show results of experiments showing the silencing effect achieved by the double resonance tube 40 provided with the resonance hole 41. In FIGS. 6A and 6B, the vertical axis represents the sound pressure level of a primary exhaust sound, and the horizontal axis represents the engine explosion primary frequency and the engine rotation speed. Besides, FIG. 6A shows the sound pressure level of the primary exhaust sound during acceleration of the engine, and FIG. 6B shows the sound pressure level of the primary exhaust sound during deceleration of the engine.

In each of FIGS. 6A and 6B, a dashed two-dotted line A shows a target level of the silencing by an exhaust silencer device, and Comparative Example 5 shown by a dotted line MA5 is a system in which the double resonance tube 40 and the resonance hole 41 on the downstream side of the sub-muffler 22 are omitted, and Example 4 shown by a solid line PI4 is a system that has the foregoing construction of the first embodiment having the resonance hole 41 and the double resonance tube 40. Furthermore, Example 5 shown by a broken line PI5 is a system in which the double resonance tube 40 is replaced by a side-branch type silencing structure, and the construction thereof will be described as a second embodiment.

From FIGS. 6A and 6B, it can be understood that merely disposing the sub-muffler 22 substantially in the middle of the first exhaust passage L1 results in the coincidence between resonance frequencies of the second exhaust passage L2 and the third exhaust passage L3, so that the silencing performance against the exhaust sound at a relatively high frequency in the vicinity of 180 Hz declines. In contrast, in Examples 4 and 5, the silencing effect slightly deteriorates in the vicinity of 110 Hz in comparison with Comparative Example 5, but a targeted silencing effect in a sound region in the vicinity of 180 Hz can be reliably achieved.

Thus, in the first embodiment, the double resonance tube 40 is attached to a portion of the exhaust pipe 10 so as to form the resonance chamber 42 that communicates with the resonance hole 41, and the resonance hole 41 makes the resonance frequencies of the second exhaust passage L2 and the third exhaust passage L3 different from each other. Therefore, good silencing performance against an unpleasant exhaust sound of a relatively high exhaust sound region can be secured. Besides, in the first embodiment, the silencing effect by the double resonance tube 40 can also be expected.

Furthermore, the double resonance tube 40 surrounding a portion of the exhaust pipe 10 can restrain the space for installing a resonance pipe while reliably achieving a silencing effect. Since the double resonance tube 40 is attached to a portion of the rear pipe 13 that forms the third exhaust passage L3 of the exhaust pipe 10, the double resonance tube 40 can easily be installed, and an effective silencing effect in the vicinity of the exhaust opening 13*e* can be expected.

Besides, since the total length of the sub-muffler 22 in the passage direction of the first exhaust passage L1 is shorter than the total length of the main muffler 21, it does not happen that a wastefully large amount of the sound absorbing material 33 is housed. Thus, the production cost and the installation space for the sub-muffler 22 can be restrained. Furthermore, since the sub-muffler 22 is disposed between the fuel tank T and the rear suspension member M of the vehicle in which the engine 1 is mounted, the sub-muffler 22 can easily be disposed on a lower surface side of the vehicle body in which space is limited.

Thus, according to the exhaust silencer device for an internal combustion engine in accordance with the first embodiment, the large-sectional area sub-muffler 22 having the multi-hole inner pipe 31 and the sound absorbing material 33 around the multi-hole inner pipe 31 is disposed near the loop of a low-frequency resonance mode of the elongated first exhaust passage L1, that is, in a middle portion of the first exhaust passage L1 where both the sound pressure and the particle velocity become high. Therefore, the air column resonance sound of the low frequency can be efficiently silenced. Furthermore, although the piping lengths of the second exhaust passage L2 and the third exhaust passage L3 on both sides of the sub-muffler 22 are substantially the same, the resonance hole 41 formed on the third exhaust passage L3 makes the resonance modes of the exhaust passages L2, L3 different from each other. Therefore, this construction restrains the silencing performance against the exhaust sound of a relatively high frequency from declining due to the coincidence of the resonance frequencies of the two exhaust passages L2, L3. In consequence, it is possible to provide a compact and low-cost exhaust silencer device that is excellent in the silencing performance against low-frequency exhaust sound and the silencing performance against relatively high-frequency while the volume of the main muffler 21 or the sub-muffler 22 is restrained.

Second Embodiment

Figure 7:
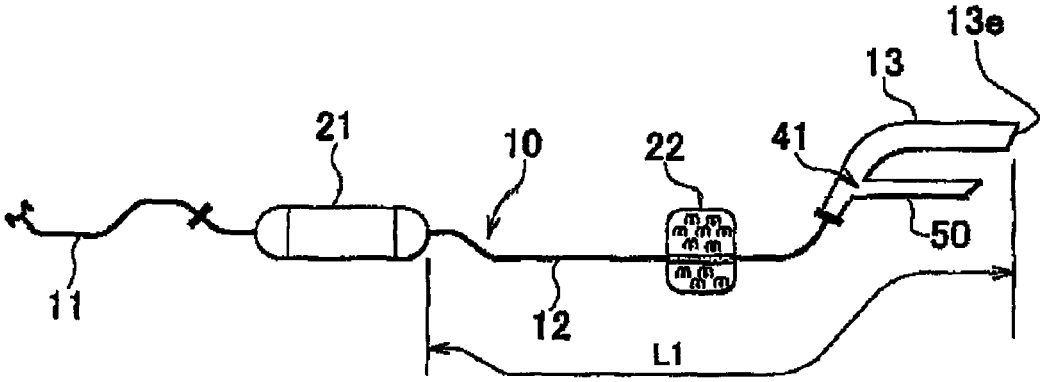
FIG. 7 is a schematic diagram showing a general construction of an exhaust silencer device for an internal combustion engine in accordance with a second embodiment of the invention.
Figure 8A:
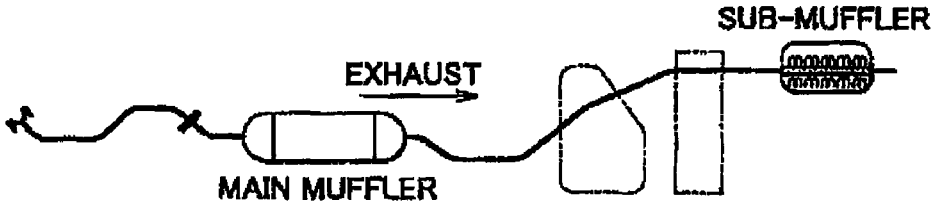
FIG. 8A RELATED ART
FIGS. 8A and 8B are illustrative diagrams for describing problems of a related art.
Figure 8B:
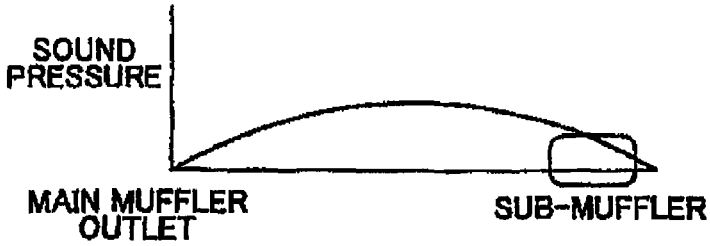

FIG. 7 is a schematic diagram showing a general construction of an exhaust silencer device for an internal combustion engine in accordance with a second embodiment of the invention. The second embodiment is different from the foregoing first embodiment merely in the construction of a rear pipe portion of the exhaust pipe 10. Portions of the second embodiment having substantially the same constructions as those in the first embodiment are represented by the same reference characters as used in FIGS. 1 to 3, and only the differences will be described in detail below.

In the exhaust silencer device for an internal combustion engine in accordance with the second embodiment, a one-end-closed type resonance tube 50 that surrounds a resonance hole 41 and braches from a rear pipe 13 of the exhaust pipe 10 is provided. Generally, the position of the resonance hole 41 needs to be set at a position where the silencing efficiency is high, if the resonance tube 50 is provided for the purpose of silencing the exhaust sound of a specific frequency. In the second embodiment, however, the resonance hole 41 is provided so as to make the resonance frequencies of the two exhaust passages L2, L3 different from each other and therefore prevent decline in the silencing performance against the exhaust sound of a relatively high frequency. Therefore, in this embodiment, the degree of freedom in setting the position of the resonance hole 41 and the length of the resonance tube 50 is high. Besides, the resonance tube 50 can be formed by using a pipe similar to the exhaust pipe 10, and can be attached thereto by a simple connecting method, such as welding or the like. Therefore, the production is easy, and contribution to cost reduction can be achieved.

Although in the foregoing embodiments, the sub-muffler 22 is disposed on the middle of the first exhaust passage L1, this is not restrictive. If the sub-muffler 22 is disposed not on a node side but a loop side of the resonance mode, a low-frequency silencing effect can be expected. Besides, although the resonance hole 41 is disposed at the downstream side of the sub-muffler 22 in the foregoing embodiments, the resonance hole may also be disposed at the upstream side thereof. Furthermore, although in the foregoing embodiments, the sectional area of the sub-muffler 22 is 20 times to 25 times the channel cross-section of the multi-hole inner pipe 31, this is not restrictive. If the sectional area of the sub-muffler 22 is at least 15 times the channel cross-section of the multi-hole inner pipe 31, a silencing effect for low-frequency sound can be expected by effectively using sound absorption function or resonance of the sound absorbing material 33. Furthermore, the holes of the multi-hole inner pipe 31 may be made smaller in diameter, or changed in shape from the circular shape to a slit shape, or may have a plurality of different diameters. Besides, if the sub-muffler 22 has a non-circular sectional shape, for example, an elliptic shape, the total length of the sub-muffler 22 may be shorter than the length of the major axis of the non-circular cross-section thereof, and the attachment position of the multi-hole inner pipe 31 to the casing 32 may be either on the centroid of the elliptic cross-section or off the centroid. Although in the foregoing embodiments, the sound absorbing material 33 is glass wool as for example, other fiber-type sound absorbing materials, such as stainless steel wool or the like, may also be used.

As described above, in the exhaust silencer device for an internal combustion engine in accordance with the invention, a muffler is disposed at a position near the loop of the resonance mode of an elongated exhaust passage, and a hole is formed on at least one of the two exhaust pipes on both sides of the muffler that have substantially equal piping lengths. Thus, it is possible to provide a compact and low-cost exhaust silencer device that is excellent in both the silencing performance against low-frequency exhaust sound and the silencing performance against relatively high-frequency exhaust sound. In the case where a main muffler and a sub-muffler are provided, the sub-muffler having a large sectional area that has a multi-hole inner pipe and a sound absorbing material around the multi-hole inner pipe is disposed near the loop of a low-frequency resonance mode of an elongated first exhaust passage, that is, in a middle portion of the first exhaust passage where both the sound pressure and the particle velocity become high, so that the air column resonance sound of the low frequency can be efficiently silenced. Furthermore, although the second exhaust passage and the third exhaust passage on both sides of the sub-muffler have substantially the same piping length, the hole formed on the second exhaust passage or the third exhaust passage makes the resonance modes of the two exhaust passages different from each other. Therefore, it is possible to restrain the coincidence of resonance frequencies of the two passages deteriorating the silencing performance against the exhaust sound of a relatively high frequency. Hence, it is possible to provide a compact and low-cost exhaust silencer device that is excellent in both the silencing performance against low-frequency exhaust sound and the silencing performance against relatively high-frequency exhaust sound while the muffler volume is restrained. The invention is useful to exhaust silencer devices for internal combustion engines, and is particularly useful generally to exhaust silencer devices for internal combustion engines that are required to have good silencing effect in a low engine speed region.

The invention claimed is:

1. An exhaust silencer device for an internal combustion engine, comprising:

an exhaust pipe that forms an exhaust passage extending from the internal combustion engine, and forms an exhaust opening; and a muffler attached to the exhaust pipe so as to silence an exhaust gas from the internal combustion engine, wherein the exhaust passage comprises a first exhaust passage extending from an outlet of an additional muffler that is attached to the exhaust pipe at a position upstream of the muffler to the muffler and a second exhaust passage extending from the muffler to the exhaust opening; the first and second exhaust passages are of equal piping lengths, and a hole is formed on at least one of the exhaust passages whereby the resonance frequencies of the first exhaust passage and of the second exhaust passages are different from each other, wherein the exhaust opening opens to atmosphere.

2. The exhaust silencer device according to claim 1, wherein the muffler includes a multi-hole inner pipe that forms a portion of the exhaust passage and that has a plurality of holes, a casing that houses and surrounds the multi-hole inner pipe, and a sound absorbing material provided in a space between the multi-hole inner pipe and the casing.

3. An exhaust silencer device for an internal combustion engine comprising:

an exhaust pipe that forms an exhaust passage extending from the internal combustion engine, and an exhaust opening;

a main muffler attached to the exhaust pipe so as to silence exhaust sound from the internal combustion engine; and a sub-muffler that is attached to the exhaust pipe and that is smaller in muffler volume than the main muffler, wherein the sub-muffler is disposed on a middle portion of a length of a first exhaust passage extending from an outlet of the main muffler to the exhaust opening of the exhaust pipe, the first exhaust passage comprises a second exhaust passage extending from the outlet of the main muffler to an inlet of the sub-muffler and a third exhaust passage extending from an outlet of the sub-muffler to the exhaust opening of the exhaust pipe; the second and third exhaust passages are of equal piping lengths;

and a hole is formed in the first exhaust passage on at least one of the second exhaust passage and the third exhaust passage whereby the resonance frequencies of the second exhaust passage and of the third exhaust passage are different from each other, wherein the exhaust opening opens to atmosphere.

4. The exhaust silencer device according to claim 3, wherein:

the sub-muffler has a multi-hole inner pipe that forms the exhaust passage and that has a plurality of holes, a casing that houses and surrounds the multi-hole inner pipe, and a sound absorbing material provided in space between the multi-hole inner pipe and the casing; and the casing forms, around the multi-hole inner pipe, a sound absorbing material-housing space having a large sectional area that is suitable to reduce a low-frequency exhaust sound that occurs corresponding to the length of the first exhaust passage.

5. The exhaust silencer device according to claim 3, wherein a resonance tube is attached to a portion of the exhaust pipe so as to form a resonance chamber that communicates with the hole.

6. The exhaust silencer device according to claim 5, wherein the resonance tube surrounds a portion of the exhaust pipe so that a double resonance tube is formed.

7. The exhaust silencer device according to claim 5, wherein the resonance tube is a one-end-closed type resonance tube that surrounds the hole and that branches from the exhaust pipe.

8. The exhaust silencer device according to claim 5, wherein the resonance tube is attached to a portion of the exhaust pipe that forms the third exhaust passage.

9. The exhaust silencer device according to claim 4, wherein the large sectional area is at least 15 times and at most 25 times as large as passage sectional area of the multi-hole inner pipe.

10. The exhaust silencer device according to claim 4, wherein the large sectional area is 20 times to 25 times as large as a passage sectional area of the multi-hole inner pipe.

11. The exhaust silencer device according to claim 3, wherein the sub-muffler is shorter in total length in a passage direction of the first exhaust passage than the main muffler.

12. The exhaust silencer device according to claim 5, wherein the large sectional area is 20 times to 25 times as large as a passage sectional area of the multi-hole inner pipe.

* * * * *